United States Patent [19]

Sasaki

[11] 4,413,373

[45] Nov. 8, 1983

[54] PIVOT HINGE WITH REMOVABLE DOOR CLOSING DEVICE

[75] Inventor: Ryoichi Sasaki, Funabashi, Japan

[73] Assignee: Nippon Electric Industry Co., Ltd., Tokyo, Japan

[21] Appl. No.: 278,463

[22] Filed: Jun. 29, 1981

[30] Foreign Application Priority Data

| | | | |
|---|---|---|---|
| Jun. 28, 1980 | [JP] | Japan | 55-90022 |
| Jun. 28, 1980 | [JP] | Japan | 55-90023 |
| Jun. 28, 1980 | [JP] | Japan | 55-90024 |

[51] Int. Cl.[3] ..... E05F 3/08; E05F 3/20

[52] U.S. Cl. ..... 16/54; 16/58; 16/76

[58] Field of Search ..... 16/50, 51, 52, 54, 55, 16/56, 57, 58, 68, 76, 82, 85, DIG. 9, DIG. 10, DIG. 17, DIG. 21; 49/137

[56] References Cited

U.S. PATENT DOCUMENTS

| | | | |
|---|---|---|---|
| 1,281,774 | 10/1918 | Franckaerts | 16/54 |
| 2,325,711 | 8/1943 | Seaman | 16/54 |
| 4,068,344 | 1/1978 | Okabe | 16/54 |
| 4,155,144 | 5/1979 | Koganei | 16/54 |

FOREIGN PATENT DOCUMENTS

| | | | |
|---|---|---|---|
| 244768 | 10/1962 | Australia | 16/54 |
| 604172 | 11/1931 | Fed. Rep. of Germany | 16/68 |
| 1227324 | 4/1971 | United Kingdom | 16/82 |
| 2033468 | 5/1980 | United Kingdom | 16/378 |

*Primary Examiner*—Fred Silverberg
*Attorney, Agent, or Firm*—Carothers & Carothers

[57] ABSTRACT

A pivot hinge for supporting the top end of a door has a door closing device which is readily attached to, and removed from, the pivot hinge. A pivot shaft is fixed by a screw to a seat plate to be secured to a door frame and a door supporting plate is pivoted on the lower end portion of the pivot shaft. The door closing device includes a housing, an annular member contained in the housing and a coil spring contained in the housing. Opposite ends of the coil spring are connected to the housing and the annular member. In attaching the door closing device to the pivot hinge, the top end of the housing is non-rotatably connected to the door supporting plate by engagement of axial grooves and axial ridges formed on both of them, while the annular member is non-rotatably connected to the lower end portion of the pivot shaft by engagement of axial grooves and axial ridges formed on both of them, so that the coil spring is twisted by door opening to generate door closing torque. In order to prevent the door closing device from falling out automatically from the pivot hinge, a supporting disk is disposed on the door supporting plate and has radial projections which are fitted in the axial grooves of the housing. The housing has an annular groove intersecting the axial grooves with which the radial projections engage by rotation of the supporting disk.

9 Claims, 7 Drawing Figures

PIVOT HINGE WITH REMOVABLE DOOR CLOSING DEVICE

BACKGROUND OF THE INVENTION

This invention relates to automatic door closing devices, and, in particular, to pivot hinges with automatic door closing mechanism.

A pivot hinge supporting the top end of a door and having an automatic door closing mechanism is well known in the prior art, as disclosed in, for example, British Pat. No. 1,227,324. However, when door closing function is not desired, it is required to exchange the pivot hinge having a door closing mechanism by a pivot hinge without door closing mechanism. On the other hand, when a door closing function is desired on a door in which a pivot hinge is used, it is required to exchange the pivot hinge with another pivot hinge having a door closing mechanism. Such an exchanging operation is complicated.

In order to simplify this operation, a pivot hinge to which a door closing device can be readily attached and removed without exchanging hinges was proposed in U.K. patent Application No. GB 2033468 A. However, the hinge disclosed in this patent application is for supporting the bottom end of the door, and cannot be used for supporting the top end of the door, because the door closing device is prone to fall down or out after long use. Also, in a pivot hinge with door closing device which utilized an oil damper, oil commonly leaks downward therefrom on to the door.

SUMMARY OF THE INVENTION

It is an object of this invention to provide a pivot hinge for supporting a top end of a door and having a door closing device which is readily removed or attached to the pivot hinge.

It is another object of this invention to provide a pivot hinge for supporting a top end of a door which has a door closing device wherein the door closing device is readily attached and removed but will not automatically fall out after long use.

It is still another object of this invention to provide a pivot hinge for supporting a top end of a door with a readily-removable door closing device having an oil damper mechanism wherein oil does not leak downwardly therefrom during long use.

It is yet another object of this invention to provide a pivot hinge for supporting a top end of a door with a readily-removable door closing device having a damper mechanism wherein door-closing speed can be readily adjustable.

It is another object of this invention to realize the above-described objects with a simple construction and a low cost.

According to this invention, a pivot hinge for supporting a door at its top end and having a door closing device easily and removably assembled thereto is obtained which comprises a pivot hinge and a door closing device. The pivot hinge comprises a first plate member to be secured to the upper portion of a door frame, a pivot pin secured to the first plate member and extending downwardly therefrom, and a second plate member secured to the top end of a door, the second plate member being pivoted on the lower end portion of the pivot pin. The door closing device comprises an outer sleeve which is a housing of this device, an inner member being rotatably mounted in the outer sleeve, and a coil spring disposed within the outer sleeve. Opposite ends of the coil spring are connected to the outer sleeve and the inner member, respectively, so that the coil spring may be twisted by relative rotation of the outer sleeve and the inner member. The door closing device is easily and removably connected to the pivot hinge at the top end thereof by a non-rotatable fitting connection between the top end of the outer sleeve and the second plate and by a non-rotatable fitting connection between the upper end of the inner member and the lower end of the pivot pin.

In an aspect of this invention, the first plate member includes a first leaf portion to be secured to the door frame and a first disk portion projecting horizontally from, and integral with, the first leaf portion. The pivot pin is secured to the first disk portion and projects downwardly from the center region of the first disk portion. The second plate member includes a second leaf portion to be secured to the door and a second disk portion projecting horizontally from, and integral with, the second leaf portion. The second disk portion is pivoted on the lower end portion of the pivot pin, and the top end portion of the outer sleeve is fitted onto the second disk portion.

The second disk portion is formed with a plurality of first axial grooves in the outer surface. The outer sleeve is formed with a plurality of second axial grooves on the inner surface of its top end portion to remain axial ridges between adjacent the second axial grooves. The outer sleeve is non-rotatably connected to the second disk portion by mating the first axial grooves with the axial ridges.

A supporting disk member is superposed onto the upper surface of the second disk portion and is rotatable about the pivot pin. It is formed with a plurality of first cut-away portions at its peripheral edge portion for mating with the axial ridges and with remaining radial projections. The outer sleeve is formed with an annular groove intersecting each axial ridge in the inner surface of the top end portion thereof so that each axial ridge has a radial recess to permit the supporting disk member to rotate in the outer sleeve. The outer sleeve is retained to the second disk portion by engagement of the radial projections with the radial recesses.

A first cover plate means is fitted onto the second disk portion and has a side plate portion. A first screw means is screwed into the side plate portion. The supporting disk member has a radial flange portion which engages with the inner end of the first screw means so that the supporting disk member is rotated by fastening the first screw means to establish the engagement of the radial projections with the radial recesses.

The door closing device further comprises a mechanism for damping the closing speed which comprises a cylinder member secured to the outer sleeve and supported therein rotatable in relation to the inner member. An oil is contained within the cylinder member. a piston member is fitted into the cylinder member. The piston is reciprocable within the cylinder member by the relative rotation of the inner member and the outer sleeve. The piston member is provided with a check valve which permits unidirectional oil flow between both sides of the piston member. The check valve prevents the oil from flowing therethrough at a time when the piston member moves due to the door closing operation, whereby the door closing speed may be damped.

The door closing device further comprises a shaft member secured to the inner member at its top end with the lower end extending into the cylinder member. The piston member is non-rotatably but axially slidably mounted on the extending portion of the shaft member. The piston member is screwed into the cylinder member, and, therefore, may rotationally reciprocate within the cylinder member by relative rotation of the outer sleeve and the inner member.

The door closing device further comprises the inner member having a first axial hole. The shaft member has a second axial hole connected with the first axial hole. A rod means is rotatably disposed to extend within the first and second axial holes and is fixed to the shaft member to prevent axial movement. A movable member is screwed to one of the extending end of the rod means and the shaft member, and is connected to the other to be non-rotatable but axially slidable so that the movable member may be axially moved in a direction in dependence on the direction of rotation of the rod means. An adjuster rod is secured to the movable member and extends therefrom into the cylinder through the oil hole of the piston member. The adjuster rod is milled to form a tapered surface whereby an oil passing gap in the oil hole along the tapered surface may be changed by rotation of the rod means. The pivot pin had a third axial hole to be connected with the first axial hole of the inner member at a time when the door closing device is assembled to the hinge. An operating rod means is disposed rotatably but axially non-movably in the third axial hole with its top head portion disposed to project from the top end of the pivot pin. The lower end of the operating rod means is formed in a form of a screw driver bit. The rod means is formed with a groove in its top end surface in which the screw driver bit end of the operating rod means is received so that the rod means is rotated by rotating the top head portion of the operating rod means to thereby adjust the door closing speed.

Further objects, features and other aspects of this invention will be understood from the following detailed description of preferred embodiments of this invention referring to the accompanying drawings.

DETAILED DESCRIPTION OF PREFERRED EMBODIMENTS

Figure 1:
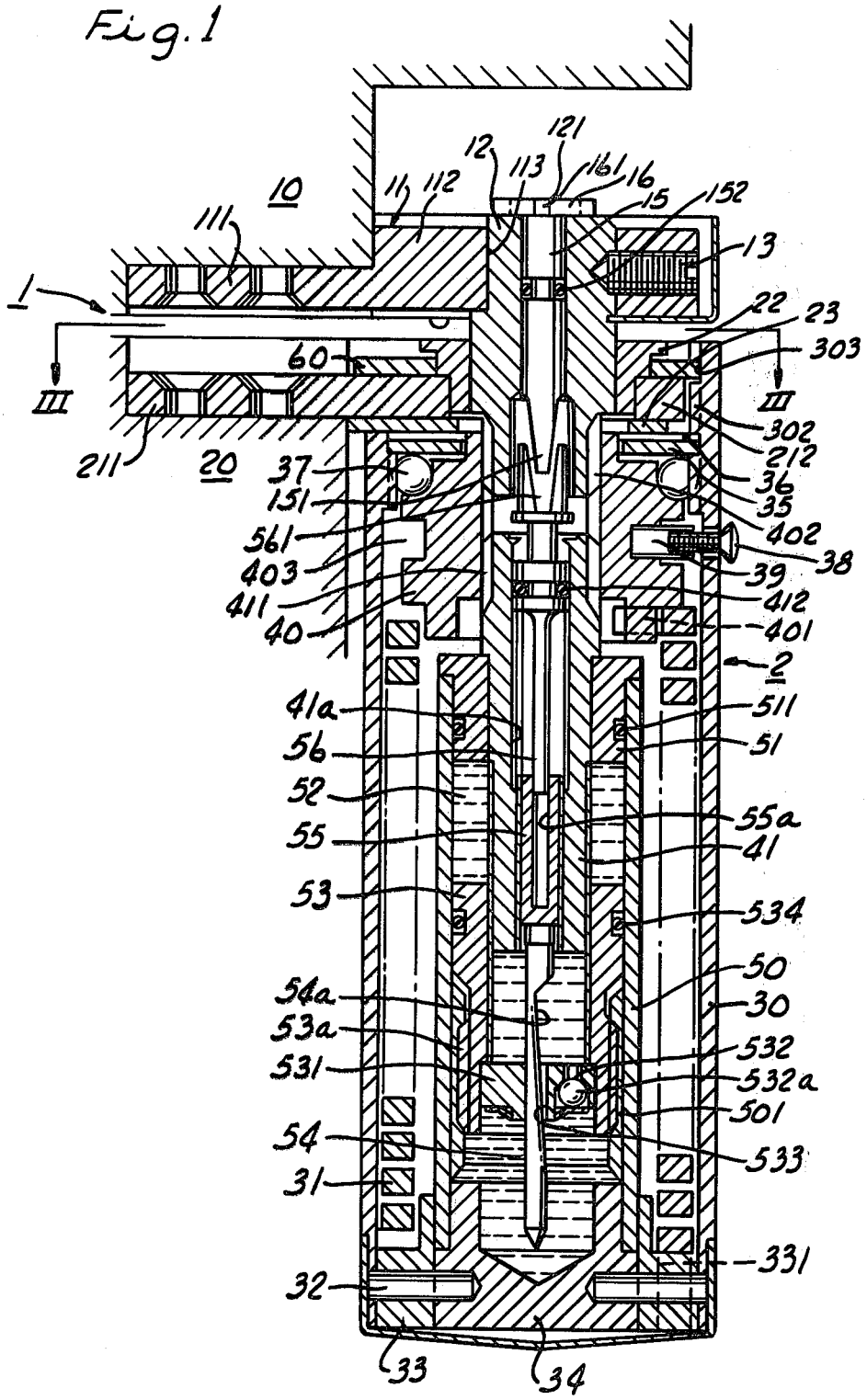
FIG. 1 is a longitudinal sectional view of an embodiment of this invention.
Figure 2:
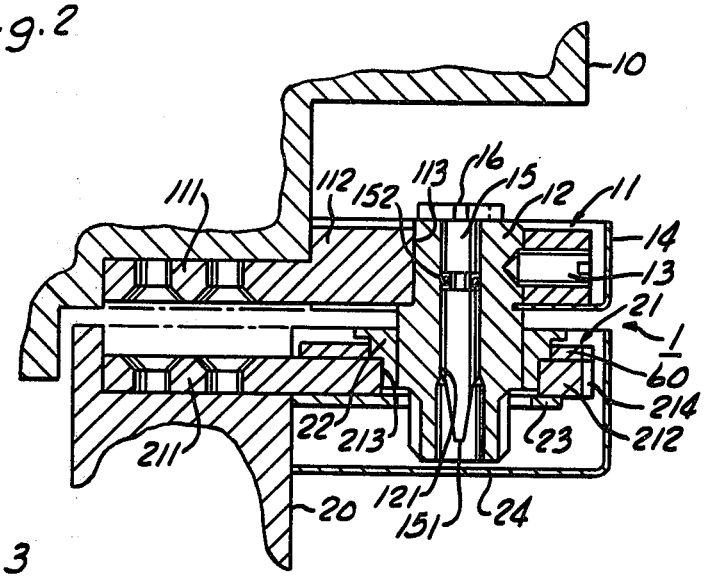
FIG. 2 is a sectional view of the pivot hinge in FIG. 1 with the door closing device being removed but with a cover plate being mounted.

Referring to FIGS. 1 and 2, in which an embodiment of this invention is shown, a pivot hinge 1 comprises a seat plate 11 to be fixed to an upper portion of a door frame 10, a vertical pin or pivot shaft 12 defining a pivot axis and secured to seat plate 11, and a door supporting plate 21 fitted rotatably to the lower end of pivot shaft 12 and to be fixed to the top end of a door 20.

Seat plate 11 comprises a leaf portion 111 which is secured to door frame 10 by screw means, and a disk portion 112 projecting horizontally from leaf portion 111. Disk portion 112 is formed with a generally half-circular hole 113 at a center region. Pivot shaft 12 is formed to have a generally half-circular contour at its upper portion which is fitted into hole 113, and is secured to seat plate 12 by a screw 13 screwed into disk portion 112 from its outer surface. Accordingly, pivot shaft 12 is secured non-rotatably to seat plate 11.

Door supporting plate 21 also comprises a leaf portion 211 which is secured to the top end of door 20 by screws, and a disk portion 212 projecting horizontally from leaf portion 211. Disk portion 212 is formed with a circular hole at its center region in which the lower end portion of pivot shaft 12 is rotatably supported by a bearing 22. Thus, door 20 is supported by pivot hinge 1 to be rotatable about a pivot axis defined by pivot shaft 12.

Cover plates 14 and 24 are provided to cover the outer surfaces of disk portions 112 and 212 of seat plate 11 and door supporting plate 21, respectively. Cover plate 24 for door supporting plate 21 is removed at a time when a door closing device 2 is attached to the hinge 1. An ornamental cover plate 23 is attached to the bottom surface of disk portion 212 of door supporting plate 21.

Door closing device 2 is easily removably attached on pivot hinge 1.

Door closing device 2 comprises an outer sleeve or housing 30 to be connected with door supporting plate 21, and an inner annular member 40 to be connected to pivot pin 12, which is disposed in, and rotatable in relation to, outer sleeve 30. A coil spring 31 is disposed within outer sleeve 30, with a lower end of coil spring 31 being connected to outer sleeve 30 and with the other upper end being connected to inner annular member 40, so that coil spring 31 is twisted by opening the door. The restoring force of the twisted spring 31 provides the door closing torque.

In the shown embodiment, a ring member 33 is disposed within a lower portion of outer sleeve 30 and is fixed thereto by pin or screw means 32. The lower end of coil spring 33 is secured by a pin 32 to ring member 33. Inner annular member 40 is formed with a groove 401 in the bottom surface in which the upper end of coil spring 31 is engaged.

Outer sleeve 30 is closed by a washer plate 35 at its upper opening, and washer plate 35 is secured by retainer ring 36 fitted into the upper opening. Inner annular member 40 is rotatably supported by a ball bearing 37 which is disposed between the outer surface of inner annular member 40 and the inner surface of outer sleeve 30.

Figure 3:
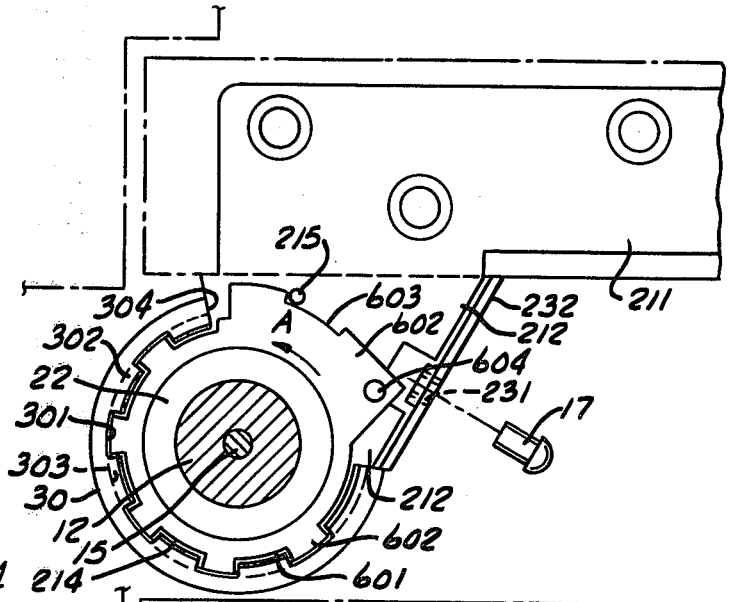
FIG. 3 is a sectional view taken along a line III—III in FIG. 1, with a retainer screw being removed.
Figure 4:
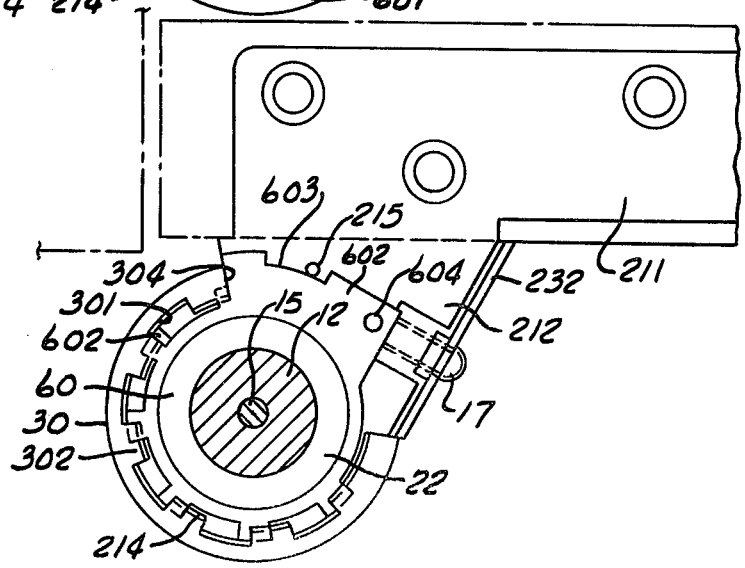
FIG. 4 is a sectional view taken along a line III—III in FIG. 1.

Referring to FIGS. 3 and 4 in addition to FIGS. 1 and 2, the top end of outer sleeve 30 is arranged to fit onto disk portion 212 of door supporting plate 21. That is, the top end portion of outer sleeve 30 is formed with a plurality of axial grooves 301 in its inner surface to form remaining axial ridges 302 and a plurality of grooves 214 are formed on the outer surface of disk portion 212 of door supporting plate 21 for mating axial ridges 302. Therefore, when the top end of outer sleeve 30 is fitted onto disk portion 212 of door supporting plate 21, relative rotation between door supporting plate 21 and outer sleeve 30 is prevented. A suitable means is used for fixing outer sleeve 30 to door supporting plate 21. A preferred arrangement for fixing outer sleeve 30 to door supporting plate 21 will be described in connection with FIGS. 3 and 4, hereinafter.

Accordingly, when door closing device 2 is attached to hinge 1 by inserting the lower end portion of pivot shaft 12 into the central hole of annular member 40 and by fitting the top end portion of outer sleeve 30 onto disk portion 212 of door supporting plate 21, coil spring 31 is twisted by door opening, and the restoring force of coil spring 31 serves to close the door.

Back to FIG. 1, inner annular member 40 is provided with a plurality of axial grooves in the inner surface and the lower end portion of pivot shaft 12 is formed with a plurality of axial ridges on the outer surface which mate with the grooves, so that, upon being received into the central hole of inner annular member 40, the lower end portion of pivot shaft 12 is non-rotatably connected to inner annular member 40 by mating the axial grooves with the axial ridges, that is, so called spline connection 402.

In the shown embodiment, a set screw 38 is radially screwed in outer sleeve 30 and engages with a pin 39 fixed in a circumferential groove 403 to selectively prevent inner annular member 40 from rotating in relation to outer sleeve 30, in order to preset the door closing torque, or the restoring force of coil spring 31. Thus, the door closing device is presetable to keep coil spring 31 in twisted condition prior to shipment from the plant, by rotating annular member 40 in relation to outer sleeve 30 to twist coil spring 31 and then screwing screw 38 to prevent rotation of annular member 40 in relation to outer sleeve 30. After the door closing device 2 is attached to the pivot hinge 1, the restoring force of twisted coil spring 31 is transmitted to door supporting plate 21 by removing set screw 38. Circumferential groove 403 extends over about 180° angular extent to permit door 20 to be opened without removing set screw 38.

In order to prevent the door from quickly closing by the restoring force of the coil spring, the shown embodiment is provided with a torque damping mechanism.

A cylindrical hollow member 50 is disposed within coil spring 31 and its lower opening is closed by a lower cap member 34 welded to cylindrical hollow member 50. Lower cap member 34 is secured to outer sleeve 30 by screw means 32 together with ring member 33. A cylinder head 51 is fitted into the top opening of cylindrical hollow member 50 and a sealing ring 511 is disposed between the inner surface of cylindrical hollow member 50 and the outer surface of cylinder head 51. A damper shaft 41 is inserted into cylindrical hollow member 50 through cylinder head 51, and is closely fitted in cylinder head 51. The top end portion of damper shaft 41 is inserted into the central hole of inner annular member 40 and is non-rotatably connected to inner annular member 40 by spline connction 411. Damper oil 52 is contained within cylindrical hollow member 50. A piston member 53 screw-threaded in the outer surface thereof is fitted within cylindrical hollow member 50, with the outer thread **53*a* mating a helical groove 501 formed in the inner surface of cylindrical hollow member 50. Piston member 53 is a hollow body, in the hollow portion of which the lower end portion of damper shaft 41 extends. Damper shaft 41 slidably but non-rotatably guides piston member 53 by spline connection therebetween. Thus, piston member 53 is upwardly or downwardly moved along damper shaft 41 by rotation of cylindrical hollow member 50 together with outer sleeve 30**.

Hollow piston member 53 is closed by a valve plate 531 welded thereto at the lower end. Valve plate 531 may be formed as an integral body of piston member 53. Valve plate 531 is provided with a small hole 532 accompanied by a valve ball **532*a* to form a check valve, and is formed with another small hole 533**.

In door opening, piston member 53 moves upwardly in the shown embodiment, damper oil 52 flows through holes 532 and 533 downwardly. When door is closed, piston member 53 moves downwardly. At the time, damper oil flows upwardly through hole 533, but the other hole 532 is closed by valve ball **532*a*. Thus, valve ball 532*a* constitutes a check valve. Accordingly, oil flow is limited by the check valve in door closing operation, whereby moving speed of piston member 53** is limited. Therefore, the door closing speed is damped.

The door closing speed is adjustable by controlling an adjuster rod 54. Adjuster rod 54 is milled to form a tapered surface **54*a*, and extends through hole 533 to establish an oil passing gap along milled tapered surface 54*a*. The upper end of adjuster rod 54 is secured to a screw 55 which is screwed into a central hole 41*a* of damper shaft 41. Screw 55 is formed with a central square hole 55*a* in which a square rod 56 is axially slidably fitted. Square rod 56 extends upwardly through central hole 41*a* of damper shaft 41, and is rotatably held to damper shaft 41 in the upper end portion thereof. Square rod 56 is formed with a groove 561 in the upper end surface. An adjuster pin 15 is fitted into a central hole 121 formed in pivot shaft 12, and its lower end 151 is formed in a form of a screw driver bit and is received in groove 561. A head 16 is formed on the top end of pin 15 and is disposed on the top end of pivot shaft 12. Therefore, when adjuster pin 15 is rotated by use of screw driver, square rod 56 is rotated and screw 55 and adjuster rod 54 are rotated and moved upwardly or downwardly in dependence on the rotating direction of adjuster pin 15. Accordingly, the oil passing gap along the tapered surface 54*a* of adjuster rod 54 in the hole 533** is adjustably changed.

The use of the tapered surface of adjuster rod 54 has another advantage that greater damping effect is obtained at the greater door opening angular position.

In FIG. 1, 152, 412 and 534 are O-rings for sealing the inner bore of the cylindrical member 50.

In order to prevent the door closing device from automatically removing from the pivot hinge during use, a supporting disk plate 60 is used.

Referring to FIGS. 3 and 4 in addition to FIGS. 1 and 2, supporting disk plate 60 which is a ring like plate is superposed on disk portion 212 of door supporting plate 21. Supporting disk plate 60 has a plurality of cut-away portions 601 at its peripheral edge portion for mating with axial ridges 302 to provide radial projections 602 projecting from its outer preipheral end. In the inner surface of the top end portion of outer sleeve 30, an annular groove 303 is formed in a direction perpendicular to respective axial ridges 302. Accordingly, when supporting disk plate 60 is rotated by a slight angular degree after outer sleeve 30 is fitted onto disk portion 212 of door supporting plate 21, annular projections 602 fit into groove 303 at respective ridges 302. Accordingly, outer sleeve 30 is prevented from being removed from door supporting plate 21.

In order to rotate supporting disk plate 60 and maintain supporting disk plate 60 in its rotated condition by the slight angle, a screw 17 is used which is screwed into a threaded hole 231 formed in a side wal portion 232 of ornamental cover plate 23. Supporting disk plate 60 is provided with a flange portion 602 projecting horizontally therefrom towards leaf portion 211. An angular end of flange portion 602 contacts with the end of screw 17 screwed into threaded hole 231, and supporting disk plate 60 is rotated, in a direction of an arrow A indicated in FIG. 3, by further fastening screw 17. The other angular end of flange portion 602 contacts with an edge 304 of the cut-away portion of outer sleeve 30 so that supporting disk plate 60 is positioned at a condition that radial projections 602 are in groove 303 of respective axial ridges 302 of outer sleeve 30, as best shown in FIG. 4.

Flange portion 602 of supporting disk plate 60 is formed with a cut-away portion 603 at its radial peripheral edge and a pin 215 is fixed onto the upper surface of door supporting plate to be disposed in cut-away portion 603 so as to restrict the rotational angular extent of supporting disk plate 60, and to position supporting plate 60 at an angular position where cut-away portions 601 are axially arranged to axial grooves 214 of disk portion 212 of door supporting plate 21. Accordingly, attachment of door closing device 2 is readily performed.

In order to disengage readily radial projections 602 from groove 303 at axial ridges 302 at a time when door closing device 2 is removed from pivot hinge 1, supporting plate 60 is provided with a pin 604 on its upper surface. Supporting disk plate 60 is rotated in a direction opposite to arrow A by drawing pin 604 by using a suitable tool or manually so that radial flange 602 are positioned in axial grooves 301 of outer sleeve 30. Thus, door closing device 2 is removed from hinge 1.

Figure 5:
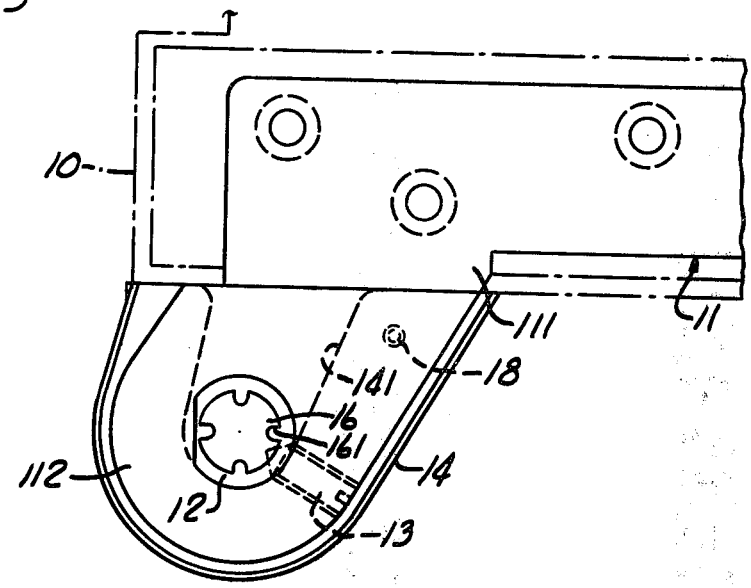
FIG. 5 is a top plan view of the pivot hinge at a door-closing condition.
Figure 6:
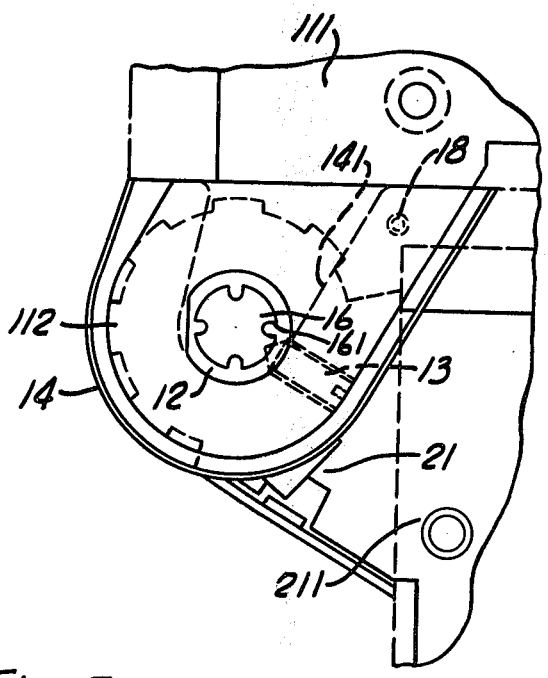
FIG. 6 is a top plan view of the pivot hinge at a door-opening condition.
Figure 7:
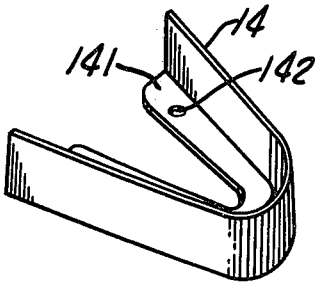
FIG. 7 is a perspective view of a cover plate for a seat plate to be fixed to a door frame.

Referring to FIGS. 5, 6 and 7 in addition to FIGS. 1 and 2, cover plate 14 is arranged not to be removed at a door closing condition. Pivot shaft 12 is secured to seat plate 11 by screw 13, as described above. This means that it is ready to install door 20 with use of pivot hinge 1. On the other hand, if pivot hinge 1 is arranged to be accessible to screw 13 at a time when door 20 is closed, door 20 is easily removed. Accordingly, in order to prevent door 20 from being removed at its closing condition, cover plate 14 is mounted on seat plate 11. Cover plate 14 covers outer surface of disk portion 112 of seat plate 11 and has a flange 141 covering the bottom surface of disk portion 112. A hole 142 is formed in flange 141 through which a screw 18 is screwed into the disk portion 112 to fix cover plate 14 to seat plate 11. In the arrangement, when door 20 is closed, screw 18 is covered with door supporting plate 21 because seat plate 11 is superposed onto door supporting plate 21. Therefore, screw 18 cannot be removed at a time when door 20 is closed.

This invention has been described in detail in connection with preferred embodiment, but this is merely example only and this invention is not restricted thereto. It will be easily understood by those skilled in the art that the other variations and modifications can be readily made within the scope of this invention.

What is claimed is:

1. In a pivot hinge for supporting a door at its top end and having a door closing device easily and removably assembled thereto, wherein said pivot hinge has a first plate member including a first leaf portion to be secured to the upper portion of a door frame and a first disk portion projecting horizontally from, and integral with, said first leaf portion, and a second plate member including a second leaf portion to be secured to the top end of the door and a second disk portion projecting horizontally from, and integral with, said second leaf portion, said first and second plate members being connected to one another by a pivot pin at said first and second disk portions, and said door closing device having an outer sleeve in which a door closing mechanism is contained, said door closing device comprises said outer sleeve, an inner member being mounted in said outer sleeve to be rotatable in relation to said outer sleeve and being removably connected to said pivot pin, and a coil spring member disposed within said outer sleeve with the lower end of said spring being connected to said outer sleeve and with the upper end being connected to said inner member so that said coil spring member may be twisted by rotation of said outer sleeve together with said second plate member in relation to said inner member to provide the door closing torque, the improvement comprising said second disk portion being formed with a plurality of first axial grooves in the outer surface thereof, said outer sleeve formed with a plurality of second axial grooves on the inner surface of its top end portion to provide axial ridges between adjacent said second axial grooves, said outer sleeve non-rotatably connected to said second disk portion by mating said first axial grooves with said axial ridges, a supporting disk member superposed onto the upper surface of said second disk portion and being rotatable about said pivot pin, said supporting disk member formed with a plurality of first cut-away portions at its peripheral edge portion for mating with said axial ridges and thereby providing radial projections, said outer sleeve formed with an annular groove intersecting each axial ridge in the inner surface of the top end portion thereof so that each said axial ridge has a radial recess to permit said supporting disk member to rotate in said outer sleeve, said outer sleeve retained to said second disk portion by engagement of said radial projections with said radial recesses.

2. A pivot hinge with a door closing device as claimed in claim 1, which further comprises a first cover plate means fitted onto said second disk portion and having a side plate portion, a first screw means screwed into said side plate portion, said supporting disk member having a radial flange portion which engages with the inner end of said first screw means so that said supporting disk member is rotated by fastening said first screw means to establish the engagement of said radial projections with said radial recesses.

3. A pivot hinge with a door closing device as claimed in claim 2, which further comprises a first pin means fixed to, and projected from, the upper surface of said supporting disk member whereby said supporting disk member may be rotated by drawing said first pin means to disengage said radial flange with said radial recesses at a time of removal of said door closing device from said pivot hinge.

4. A pivot hinge with a door closing device as claimed in claim 2, which further comprises a second pin means secured to, and projecting from, the upper surface of said second disk portion, said radial flange formed with a second cut-away portion over a predetermined angular extent at its peripheral portion, said second pin means disposed in said second cut-away portion to limit rotational angle of said supporting disk member.

5. A pivot hinge with a door closing device as claimed in claim 1, wherein said first disk portion is formed with a generally half-circular hole at its center region, the top end portion of said pivot pin being formed to have a generally half-circular contour and fitted into said generally half-circular hole, a first screw means screwed into said first disk portion from its outer side surface to fasten and retain said pivot pin to said second disk portion.

6. A pivot hinge with a door closing device as claimed in claim 5, which further comprises a second cover plate means fitted to said first disk portion to cover the outer side surface and the bottom surface of said first disk portion, a second screw means screwed into said first disk portion through said second cover plate means from the bottom side so that it is prevented by said second disk portion to gain access to said second screw means at a door closed condition.

7. A pivot hinge with a door closing device as claimed in claim 1, wherein said door closing device further comprises a mechanism for damping the door closing speed which comprises a cylinder member being secured to said outer sleeve and being supported therein rotatable in relation to said inner member, an oil contained within said cylinder member, a piston member fitted into said cylinder member, said piston member being reciprocable within said cylinder member by the relative rotation of said inner member and said outer sleeve, said piston member being provided with a check valve which permits unidirectional oil flow between both sides of said piston member, and said check valve preventing the oil from flowing therethrough at a time when said piston member moves due to the door closing operation, whereby the door closing speed may be damped.

8. A pivot hinge with a door closing device as claimed in claim 7, wherein said door closing device further comprises a shaft member secured to said inner member at its top end with the lower end extending into said cylinder member, said piston member being non-rotatably but axially slidably mounted on said extending portion of said shaft member, while said piston member being screwed into said cylinder member, whereby said piston member may rotationally reciprocate within said cylinder member by relative rotation of said outer sleeve and said inner member.

9. A pivot hinge with a door closing device as claimed in claim 8, wherein said door closing device further comrises said inner member having a first axial hole, said shaft member having a second axial hole connected with said first axial hole, a rod means rotatably disposed to extend within said first and second axial holes and being fixed to said shaft member to prevent axial movement, a movable member being disposed in said second axial hole, said movable member being screwed to one of the extending end of said rod means and said shaft member while being connected to the other to be non-rotatable but axially slidable so that said movable member may be axially moved in a direction in dependence on the direction of rotation of said rod means, and an adjuster rod being secured to said movable member and extending therefrom into said cylinder through said oil hole of said piston member, said adjuster rod being milled to form a tapered surface whereby an oil passing gap in said oil hole along said tapered surface may be changed by rotation of said rod means, said pivot pin having a third axial hole to be connected with said first axial hole of said inner member at a time when said door closing device is assembled to said hinge, an operating rod means disposed rotatably but axially non-movably in said third axial hole with its top head portion disposed to project from the top end of said pivot pin and with its lower end being formed in a form of a screw driver bit, said rod means being formed with a groove in its top end surface in which said screw driver bit end of said operating rod means is received so that said rod means is rotated by rotating said top head portion of said operating rod means to thereby adjust the door closing speed.

* * * * *